United States Patent [19]

Marco et al.

[11] 4,215,171

[45] Jul. 29, 1980

[54] ELASTOMER MODIFIED TEXTILE MATERIAL AND METHOD OF PRODUCING SAME

[75] Inventors: Francis W. Marco, Pauline; Hans H. Kuhn, Spartanburg, both of S.C.

[73] Assignee: Milliken Research Corporation, Spartanburg, S.C.

[21] Appl. No.: 912,122

[22] Filed: Jun. 2, 1978

Related U.S. Application Data

[63] Continuation of Ser. No. 753,367, Dec. 22, 1976, abandoned.

[51] Int. Cl.[2] ..... B32B 7/00

[52] U.S. Cl. ..... 428/245; 427/389.9; 428/246; 428/250; 428/252; 428/265

[58] Field of Search ..... 526/52.2, 49; 427/390 R, 381; 428/245, 246, 252, 265, 266, 267, 289, 290; 156/110 A

[56] References Cited

U.S. PATENT DOCUMENTS

| | | | |
|---|---|---|---|
| 3,962,511 | 6/1976 | Foti | 427/390 |
| 3,969,551 | 7/1976 | Ellsworth | 427/390 R |

*Primary Examiner*—James J. Bell

*Attorney, Agent, or Firm*—H. William Petry; Terry T. Moyer

[57] ABSTRACT

A method for producing an elastomer modified textile material which comprises coating a textile substrate with at least 1 weight percent of an amine substituted elastomer, curing the resulting elastomer coated substrate, and thereafter recovering the elastomer modified material. The elastomer modified material possesses improved adhesion properties for subsequent laminating of a second substrate thereto.

15 Claims, No Drawings

ELASTOMER MODIFIED TEXTILE MATERIAL AND METHOD OF PRODUCING SAME

This is a continuation of application Ser. No. 753,367, filed Dec. 22, 1976, now abandoned.

This invention relates to an elastomer modified material. In one aspect it relates to an elastomer modified textile material having improved adhesion properties. In yet another aspect it relates to an improved method for producing elastomer modified textile materials.

Rubber coated fabrics have found use in industrial applications where their characteristic odor and color limitations are not objectionable. Such fabrics are frequently used in the manufacture of products requiring very low temperature flexibility, such as balloon bags, diaphragms, gaskets, conveyor belts, tire cords, inflatable life rafts, pontoons and the like.

Various methods have heretofore been employed in producing rubber coated fabrics, such as application of the rubber or latex constituents as an organic solvent dispersion or by the so-called hot-roll calendering technique. The choice of coating technique has generally been dictated by the manufacturer or the end use for which the rubber coated fabric is intended.

Problems have, however, been encountered in that many of the rubber coated fabrics have lacked sufficient adhesion properties for lamination of another or different substrated to the rubber coated fabric. The insufficient adhesion properties of the rubber coated fabrics have often resulted in separation of the laminated products. Problems of separation have especially been severe when using a polyester or polyester containing textile material as the initial fabric substrate onto which the rubber or elastomer is coated. Because of the availability of such polyester or polyester containing fabrics, and the properties which such fabrics impart to a rubber or elastomer coated laminated product, new and improved elastomer coated textile materials, and processes for producing same have long been sought.

Therefore, an object of the present invention is to provide elastomer coated textile materials having improved adhesion properties.

Another object of the invention is to provide an improved method for producing elastomer coated textile materials.

These and other objects, advantages and features of the present invention will be apparent to those skilled in the art from a reading of this disclosure.

Broadly, the present invention relates to elastomer modified textile materials having improved adhesion properties and to methods for producing same. More specifically, the elastomer modified textile materials are produced by coating a textile substrate with at least about 1 weight percent of an amine substituted elastomer, curing the resulting elastomer coated substrate and thereafter recovering an elastomer modified textile material having improved adhesion properties.

In a more specific aspect, a polyester or polyester containing textile material is coated with from about 1 to about 50 weight percent based on the weight of the textile material of an amine substituted elastomer. Thereafter, the resulting amine coated polyester or polyester containing textile material is cured for an effective period of time at a temperature in the range of from about 75° to about 480° F. The elastomer modified textile material so produced possesses improved adhesion properties which, when laminated to a second textile material or a different elastomer, results in a laminated product having improved resistance to separation.

The textile material employed as the textile substrate to produce the elastomer modified textile materials of the present invention can be any suitable textile material containing natural and/or synthetic fibers. Examples of suitable textile materials are those containing fibers of polyester, nylon, acetate, Kevlar, wool, cotton, linen, silk, acrylic, and mixtures or blends of such synthetic and natural fibers. Especially desirable results can be obtained employing the method of the present invention to produce an elastomer modified textile material having improved adhesion properties when a polyester or polyester containing textile material is employed as the textile substrate.

Once the textile material to be used as the textile substrate has been selected the material is coated with an effective amount of an amine substituted elastomer to insure that at least one side or surface portion of the textile material is substantially coated with the elastomeric constituent. The amount of amine substituted elastomer employed can vary widely, but will generally be in an amount of at least about 1 weight percent, based on the weight of the textile substrate. Desirable results can be obtained when the amine substituted elastomer is employed in an amount of from about 1 to about 50 weight percent, preferably from about 5 to about 20 weight percent.

The term "amine substituted elastomer" as used herein is to be understood to include terminal or nonterminal amine substituted elastomers and mixtures thereof. The term "elastomer" is to be further understood to include those compounds having the properties of natural, reclaimed, vulcanized or synthetic rubber, e.g. compounds which stretch under tension, have a high tensile strength, retract rapidly and recover their original dimensions. Typical of such elastomers are natural rubber, homopolymers, such as polychlorobutadiene, polybutadiene and polyisoprene, copolymers, such as styrene-butadiene rubber, butyl rubber, nitrile rubber, ethylenepropylene copolymers, and polyacrylic compounds, and polycondensation products such as polyurethanes, silicone rubber and the like.

The average molecular weight of the elastomers which can be aminated to produce the amine substituted elastomers for use in the present invention can vary widely. Generally such elastomers will have an average molecular weight in the range of from about 100 to about 500,000. Especially desirable results can be obtained when the elastomer has an average molecular weight of from about 300 to about 10,000.

The amine moieties substituted onto the elastomer backbone can be primary amines, secondary amines or tertiary amines. Typical of such amine moieties are $—NH_2$, —NHR and $—NRR_1$ wherein R and $R_1$ are alkyl, aryl, alicyclic, substituted alkyl, substituted aryl and substituted alicyclic groups. Especially desirable results can be obtained when the amine moieties are $NH_2$.

The degree of amine substitution on the elastomer backbone can vary widely. However, it is generally desirable that the amine substituted elastomer have an average of at least two amine moieties.

The amine substituted elastomer can be applied to the textile material substrate by any suitable manner. For example, if the particular amine substituted elastomer is in a liquid state such can be applied by spraying or dipping of the substrate into a bath containing the liquid elastomer. Thereafter, the elastomer coated substrate is passed under a knife blade of between nip rollers to insure a substantially uniform elastomer coating. If the amine substituted elastomer is in a solid or particulate state the elastomer can be applied to the textile material substrate by the hot roll calendering technique, or, when in a particulate form, as a liquid admixture or dispersion. When applying the amine substituted elastomer to the textile substrate as a liquid admixture any suitable liquid can be employed which is substantially inert to the elastomer, e.g. does not readily react with the elastomer. Typical of such carrier liquids are water, toluene and chlorinated hydrocarbon solvents such as chloroform, carbon tetrachloride, tetrachloroethylene, methylene chloride and the like.

The amount of amine substituted elastomer present in the liquid admixture or dispersion can vary widely. However, sufficient elastomer must be present to provide a deposition, based on the dry weight of the elastomer, of at least 1 weight percent of the elastomer. Desirably, the amount of amine substituted elastomer present in the admixture will be that required to provide from about 1 to about 50 weight percent of the elastomer on the textile substrate, preferably from about 5 to about 20 weight percent.

When applying the amine substituted elastomer to the substrate as a liquid admixture or dispersion, it is desirable to thereafter remove the carrier liquid from the elastomer and, when applicable, the textile substrate to improve the bonding of the amine substituted elastomer to the textile substrate. The removal of the liquid carrier can be accomplished by drying the amine substituted coated textile material for an effective period of time to remove substantially all of the carrier liquid. Any suitable means well known in the art can be employed. For example, the coated textile substrate can be heated to drive off the carrier liquid and produce a substantially dry material. In such case, however, care must be exercised to insure that the heating of the coated textile material is maintained below the curing temperature of the amine substituted elastomer to prevent entrappment of solvent therein.

The elastomer modified material so produced can then be bonded to a second elastomer or a second textile substrate. The particular choice of the second elastomer or textile substrate will be dependent, to a large extent, on the end use of the resulting laminated product. Any suitable elastomer can be employed as the second elastomer, such as natural rubber, reclaimed rubber, vulcanized rubber or synthetic rubber. Typical of such synthetic rubber are homopolymers, such as polychlorobutadiene, polybutadiene and polyisoprene, copolymers, such as styrene-butadiene rubber, butyl rubber, nitrile rubber and polyacrylates, and polycondensation products, such as polyurethanes, silicone rubber and polysulfide rubber. Any suitable textile material, such as those containing fibers of polyester, nylon, acetate, Kevlar, wool, cotton, linen, silk, acrylic and mixtures or blends of such synthetic and natural fibers. Desirably the second textile material will be a polyester or a polyester containing textile material.

Once the desired second elastomer or second textile substrate has been selected, the selected second component, preferably in sheet form, is contacted with the surface portion of the elastomer modified material containing the amine substituted elastomer. Thereafter, the resulting laminated product is subjected to an additional curing step to securely bond the second component to the elastomer modified material through the amine substituted elastomer.

The curing conditions employed to bond the second substrate component to the elastomer modified material can vary widely, such depending to a large measure on the composition of the second substrate component. Generally, however, such additional curing is effected by maintaining the resulting laminated product at a temperature in the range of from about 75° F. to about 480° F. for a period of time of from about 5 seconds to about 20 minutes. Further, the resulting laminated product may be subjected to pressure during the curing step. When employing pressure, such will generally be in the range of from about 5 psi to about 500 psi.

It is to be understood that many variations can be made in the method and products of the present invention without departing from the spirit thereof. For example, it is to be understood that a resulting laminated product having improved adhesion and thus improved resistance to separation of the substrates or layers of the laminated product by coating at least one surface of two substrates with an amine substituted elastomer, curing the amine substituted elastomer coated substrates and thereafter forming a resulting laminated product from the two amine substituted elastomer coated substrates. The resulting laminated product, which is formed so as to allow the amine substituted elastomer coated portion of one substrate to be in contact with the amine substituted elastomer coated portion of the second substrate is then cured and a resulting laminated product is recovered. Many other variations will be apparent from a reading of the disclosure.

In order to illustrate further the details of the method of the invention, and the product produced thereby, the following specific example is given. The example is presented primarily for the purpose of illustration and any enumerations or details contained therein are not to be interpreted as a limitation on the invention except as indicated in the appended claims. All weight referred to in the example are parts by weight unless otherwise indicated.

EXAMPLE

An experiment was conducted to determine the effectiveness of a polybutadiene nitrile amine terminated rubber having an average of from about 2.3 $—NH_2$ groups per molecule (an amine substituted elastomer) as a bonding agent for polyester fabric and a compounded styrene-butadiene test rubber. A second experiment was also conducted using a polybutadiene nitrile rubber (non-amine substituted elastomer) as a bonding agent for polyester fabric and the compounded styrene-butadiene test rubber.

In each experiment the bonding agents were liquid rubber components having approximately the same average molecular weights, e.g. about 3600. The bonding agents were applied to substantially identical polyester fabrics so as to provide about 2.5 weight percent of the polybutadiene nitrile amine terminated rubber on one of the polyester fabric substrates and about 2.4 weight percent of the polybutadiene nitrile rubber on another polyester fabric substrate. Thereafter, each of the elastomer coated substrates was cured for 5 minutes at a temperature of 425° F.

Laminates were then formed using the elastomer modified polyester substrates and a compounded styrene-butadiene test rubber. The laminates, which were substantially identical except for the variation in bonding agent, were put in a press and cured at 300° F. for 30 minutes at 100 psi.

The resulting laminated products, after cooling, were cut into one (1) inch wide strips and thereafter the strips were subjected to a standard peel test. The peel test revealed that the laminate containing the polybutadiene nitrile rubber (non-amine substituted) bonding agent had an adhesion factor of 4.5 pounds; whereas, the laminate containing the polybutadiene nitrile amine terminated rubber bonding agent had an adhesion factor of 11.1 pounds.

Since the higher the adhesion factor the better the bond created between the segments of the laminate, the above example clearly indicates the improved adhesion properties obtained when employing an amine substituted elastomer as a bonding agent.

Having thus described the invention, we claim:

1. A method for producing an elastomer modified textile material having improved adhesion properties which consists essentially of coating the textile substrate with from about 1 to about 50 weight percent of an amine substituted natural or synthetic rubber elastomer, said elastomer having an average of at least two amine moieties substituted onto the elastomer backbone and further characterized as having an average molecular weight in the range of from about 100 to about 500,000, curing the resulting elastomer coated substrate, and thereafter recovering said elastomer modified textile material.

2. The method of claim 1 wherein said textile substrate is selected from the group consisting of a polyester fabric or a polyester-containing fabric.

3. The method of claim 2 wherein said curing is carried out at a temperature in the range of from about 75° to about 480° F.

4. The method of claim 3 which includes contacting a second substrate to said elastomer modified material, and curing the resulting laminated textile material.

5. The method of claim 5 wherein said laminated textile material is cured at a pressure of from about 5 psi to about 500 psi.

6. The method of claim 5 wherein said second substrate is selected from the group consisting of a polyester fabric, a polyester containing fabric or a second elastomer.

7. The method of claim 3 wherein said elastomer is applied to said substrate as a liquid admixture and which, prior to curing, includes the step of drying the elastomer coated fabric to remove carrier liquid of said liquid admixture.

8. The method of claim 7 wherein said elastomer is present in said admixture in an amount sufficient to provide from about 5 to about 20 weight percent of said elastomer on said fabric and said elastomer has an average molecular weight in the range of from about 300 to about 10,000.

9. The method of claim 8 wherein the carrier liquid of said admixture is selected from the group consisting of water, toluene, and chlorinated hydrocarbon solvents.

10. The method of claim 9 wherein said amine substituted elastomer is a polybutadiene nitrile amine terminated rubber having an average molecular weight of about 3,600.

11. An elastomer modified textile material consisting essentially of a textile substrate having from about 1 to about 50 weight percent of an amine substituted natural or synthetic rubber elastomer laminated on at least one face portion of said textile substrate, said elastomer being characterized as having an average of at least two amine moieties substituted onto the elastomer backbone and having an average molecular weight in the range of from about 100 to about 500,000.

12. The elastomer modified textile material of claim 11 wherein said elastomer is present in an amount of from about 5 to about 20 weight percent and said elastomer has an average molecular weight of from about 300 to about 10,000.

13. The elastomer modified textile material of claim 12 wherein a second substrate is laminated to said elastomer modified textile material through said amine substituted elastomer.

14. The elastomer modified textile material of claim 13 wherein said second substrate is a polyester fabric, polyester-containing fabric and a second elastomer.

15. The elastomer modified textile material of claim 14 wherein said amine substituted elastomer is a polybutadiene nitrile amine terminated rubber having an average molecular weight of about 3,600.

* * * * *